United States Patent [19]

Goto

[11] Patent Number: 4,801,223

[45] Date of Patent: Jan. 31, 1989

[54] MASK STRUCTURE FOR TYPE BELT OF PRINTER

[75] Inventor: Atsushi Goto, Iwate, Japan

[73] Assignee: Alps Electric Co., Ltd., Japan

[21] Appl. No.: 112,674

[22] Filed: Oct. 23, 1987

[30] Foreign Application Priority Data

Feb. 13, 1987 [JP] Japan ..... 62-18799

[51] Int. Cl.[4] ..... B41J 1/20

[52] U.S. Cl. ..... 400/145.1; 400/146; 400/645.1; 101/93.14

[58] Field of Search ..... 400/146, 248, 145, 145.1, 400/145.2, 248, 642, 645.1; 101/93.13, 93.14, 105, 111

[56] References Cited

U.S. PATENT DOCUMENTS

| | | | |
|---|---|---|---|
| 1,381,798 | 6/1921 | Charles | 400/145 |
| 2,018,482 | 10/1935 | Bates | 400/145.2 |
| 3,133,497 | 5/1964 | Martin | 101/111 |
| 4,455,936 | 6/1984 | Hori | 400/146 |
| 4,458,589 | 7/1984 | Watanabe et al. | 400/145.2 |
| 4,589,787 | 5/1986 | Seki et al. | 400/145.2 |
| 4,673,305 | 6/1987 | Crystal | 400/144.2 |

FOREIGN PATENT DOCUMENTS

| | | | |
|---|---|---|---|
| 144777 | 9/1982 | Japan | 101/93.14 |

*Primary Examiner*—David A. Wiecking

*Attorney, Agent, or Firm*—Guy W. Shoup; Paul J. Winters; Leighton K. Chong

[57] ABSTRACT

A printer having a platen, a type belt having a plurality of types arranged oppositely to the platen and projected at an interval on a belt body thereof, a carriage for placing a hammer member for pressing the desired type of the type belt movably arranged on the back of the type belt on the platen, and a mask member supported to the carriage and disposed between the platen and the type belt characterized by said mask member having a slope for disposing the type side used for printing in the vicinity of the platen, thereby preventing inks from mixing and preferably printing a desired type by a small pressing force.

3 Claims, 3 Drawing Sheets

MASK STRUCTURE FOR TYPE BELT OF PRINTER

BACKGROUND OF THE INVENTION

1. Field of the Invention

This invention relates to a type belt type printer used for an electronic calculator and, more particularly, to an improvement in the mask member for the printer.

2. Description of the Prior Art

FIG. 3 is a plan view showing a general type belt type printer of this sort. A pinion 4 is engaged with the output shaft 3 of an electric motor 2 supported to a frame 1, and the rotation of the pinion 4 is transmitted through a pair of idle gears 5 and 6 to a drive pulley 7. A selection lever 8 is rotatably arranged near the drive pulley 7. The rotation of the drive pulley 7 is stopped by engaging the pawl 9 of the selection lever 8 with the drive pulley 7. An electromagnetic clutch 10 is disposed near the selection lever 8. When the clutch 10 is energized, the selection lever 8 is rotated to engage the pawl 9 with the drive pulley 7.

The drive pulley 7 is disposed at one side of the frame 1, and a driven pulley 11 is disposed at the other side of the frame 1. A type belt 12 in which a number of types 14, 14, . . . are projected at an interval on a belt body 13 is wound, as shown in detail in FIG. 4, on the drive pulley 7 and the driven pulley 11.

A platen 15 supported to the frame 11 is arranged in front of the type belt 12, and a carriage 16 which places a hammer member 17 for pressing the desired type 14 of the type belt 12 of the platen 15 side on the platen 15 is disposed laterally movably by a mechanism (not shown) inside the type belt 12. A pair of mask members 18, 18 for preventing the types 14 of both sides of the desired type 14 from being printed when pressing the desired type 14 of the type belt 12 on the platen 15 by the hammer member 17 are supported in a cantilever state to be disposed between the type belt 12 and the platen 15 at an interval corresponding to one of the type 14 at the right and left sides on the lower end of the carriage 16.

The carriage 16 is returned to a home position in a free state by a spring member 19. A sheet S is supplied by a pinch roller 20 and a sheet feed roller, not shown, between the type belt 12 and the carriage 16. Further, an ink roller 21 for coating the type 14 of the type belt 12 with ink is arranged on the type belt 12 near the driven pulley 11.

According to the construction as described above, the rotation of the motor 2 is transmitted from the pinion 4 through the idle gears 5, 6 to the drive pulley 7 to rotate the drive pulley 7. Thus, the type belt 12 is rotated together with the driven pulley 11. When the electromagnetic clutch 10 is energized, the selection lever 8 is rotated to engage the pawl 9 with the drive pulley 7 to stop rotating of the drive pulley 7, thereby stopping the desired type 14 at the position opposite to the carriage 16. The hammer member 17 is driven in the carriage 16, the type 14 is pressed on the sheet S disposed in front of the platen 15 to transfer the ink coated on the type 14 on the sheet S, thereby finishing the print of first digit. Then, the clutch 10 is deenergized to carry the carriage 16, the abovedescribed operation is repeated for necessary digits to finish to print one row. Then, the carriage 16 is returned to the home position by the spring member 19. The sheet S is fed by one row by the pinch roller 20 and the sheet feed roller (not shown), and is introduced to next row for printing.

Even when multicolor printing in the conventional printer of the construction as described above, a plurality of ink rolls 21 are provided to coat selectively exclusive color types 14 with inks of specific colors to be intended to multicolor print, the inks are mixed by adhering the inks mixed from the mask members 18 to the type 14 in contact of the type 14 with the mask members 18 since the mask members 18 are contacted with all the color types 14 to disable fresh multicolor printing.

Thus, as shown in FIGS. 5(A) and 5(B), a printer in which types 14 projected at an interval on the type belt 12 are disposed inside from the ends 22, 22 (one of which is shown) of the belt body 13 laterally of the belt body 13, a pair of horizontal supports 23, 23 (one of which is shown) projected forward are projected at the upper and lower portions of the carriage 16, and a pair of mask members 18A and 18A (one of which is shown) disposed between the type belt 12 and the platen 15 are bent substantially perpendicularly to the belt body 13 side at an interval at right and left sides at the front ends of the supports 23 is already filed by the same assignee as this invention. In this prior invention, as described in copending U.S. Patent application Ser. No. 090,167 the belt body 13 on mask members 18A, 18A,. . . are arranged to contact the both sides of the types 14*a*, 14*a* to hold the types 14*a*, 14*a* disposed at both sides of the type 14 pressed on the platen 15 by the hammer member 17.

According to the construction as described above, as shown in FIG. 5(B), when the hammer member 17 is energized to press the end of the hammer member 17 on the back of the desired type 14 of the type belt 12, the types 14*a*, 14*a* adjacent to the type 14 are pulled to the type 14 to be printed to press in a direction for approaching the platen 15. Before the type 14 to be printed is pressed on the platen 15, the belt 15 of the types 14*a*, 14*a* at both sides are contacted with the mask members 18A to prevent the types 14*a*, 14*a* from moving forward. Thus, only the desired type 14 is thereafter moved forward to press it on the platen 15, thereby printing the type 14 on the sheet S on the platen 15.

Such a mask member 18A is not directly contacted with the type 14 of the type belt 12 as described above, but is contacted with the belt body 13 of both sides of the type 14*a*. Thus, the inks are not possibly mixed through the mask member 18A, thereby freshly multicolor printing.

However, in the prior invention described above, the mask member 18A is extended parallel to the extending direction of the belt body 13 of the type belt 12. Therefore, when the pressing force acting on the hammer member 17 for pressing the desired type 14 on the platen 15 is not large after the belt body 13 of both sides of the type 14*a* is contacted with the mask member 18A, preferable printing cannot be performed on the sheet S due to the presence of the mask member 18A. Consequently, a problem arises that a large size of pressing member having large pressing force for pressing the hammer member 17 must is required.

SUMMARY OF THE INVENTION

Accordingly, an object of this invention is to provide a printer which can eliminate the above-mentioned problems and can prevent inks from mixing and preferably print a desired type by a small pressing force.

In order to achieve the above and other objects of the invention, there is provided a printer having a platen, a type belt having a plurality of types arranged oppositely to the platen and projected at an interval on a belt body thereof, a carriage for placing a hammer member for pressing the desired type of the type belt movably arranged on the back of the type belt on the platen, and a mask member supported to the carriage and disposed between the platen and the type belt characterized by said mask member having a slope for disposing the type side used for printing in the vicinity of the platen.

According to the invention, since the mask member for preventing the type adjacent to the desired type from moving has the slope when the hammer member is contacted with the back of the desired type of the type belt to press the desired type toward the platen, the belt body of the position adjacent to the desired type can be projected forward along the slope of the mask member, thereby preferably printing the desired type by a small pressing force.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

Figure 1:
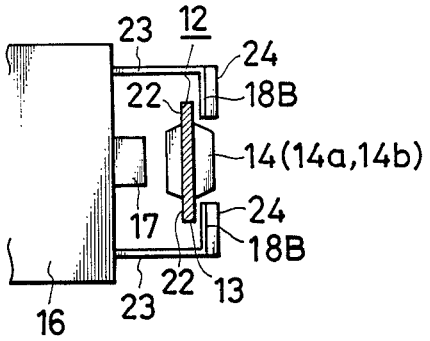
FIG. 1 is a longitudinal sectional side view of an essential portion of an embodiment of a printer according to the present invention.

Embodiments of a printer according to the present invention will be described in detail with reference to the accompanying drawings, wherein the same reference numerals as those in the prior art described previously designate the same or equivalent parts, and detailed description thereof will be omitted.

Figure 2A:
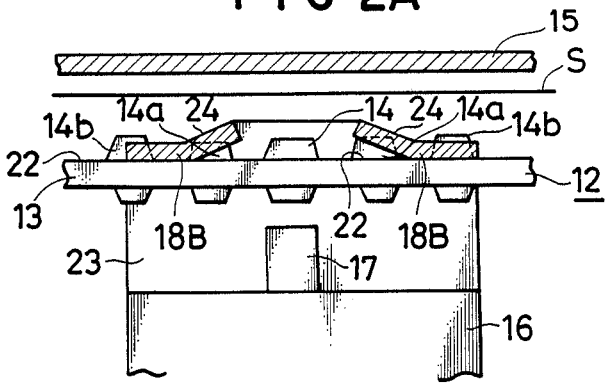
FIGS. 2(A) and 2(B) are longitudinal sectional plan views showing the operation of the embodiment in FIG. 1.
Figure 2B:
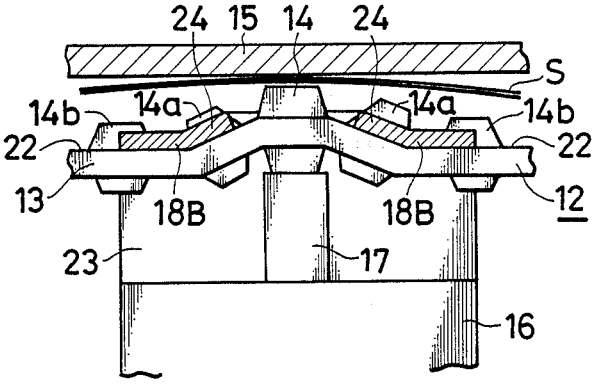
Figure 3:
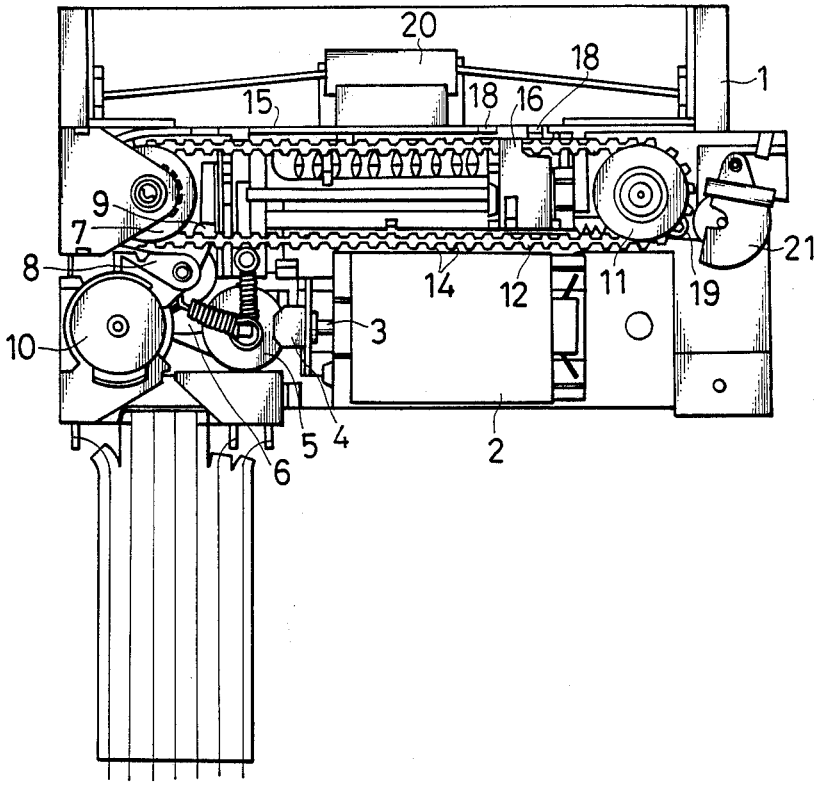
FIG 3 PRIOR ART
FIG. 3 is a plan view of a general printer.
Figure 4:
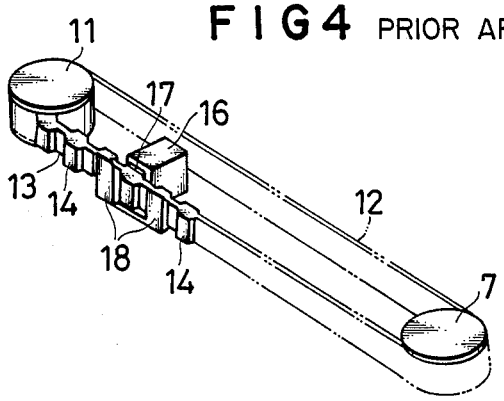
FIG 4 PRIOR ART
FIG. 4 is an enlarged perspective view of the essential portion of FIG. 3.
Figure 5A:
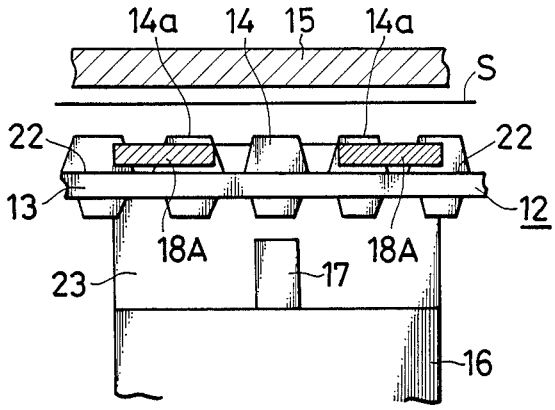
FIG 5A PRIOR ART
FIGS. 5(A) and 5(B) are plan views of an essential portion of a conventional printer.
Figure 5B:
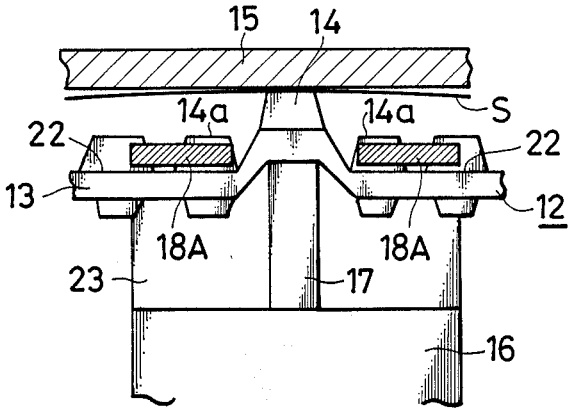
FIG 5B PRIOR ART

FIGS. 1 and 2(A), 2(B) show an embodiment of a printer according to the invention. A pair of mask members 18B and 18B are projected to bent perpendicularly at an interval at right and left sides of the ends of a pair of plate-like supports 23 and 23 projected forward from the upper and lower portions of a carriage 16. The pair of mask members 18B and 18B projected on the support 23 of the upper portion of the carriage 16 are formed downward, and the pair of mask members 18B and 18B projected from the support 23 of the lower portion of the carriage 16 are formed upward. Thus, upper and lower mask members 18B and 18B are opposed to each other. The interval of the mask members 18B and 18B projected from the supports 13 is equal to the length of the desired type 14 opposed on the back to the hammer member 17, and the length of the mask member 18B is substantially equal to the length added by the length of approx. 1.5 times of the type 14 and the interval between the types 14*a* and 14*a*. Therefore, the mask member 18B is arrived from the end of the type 14 side of the type 14*a* adjacent to the desired type 14 to the intermediate portion of the next type 14*b*.

In the invention, the mask member 18B is formed with a planar slope 24 from the inner end of the mask member 18B in a range corresponding to the entire area of the type 14*a* as the planar slope 24 approaching the platen 15 at the inner end, i.e., toward the type 14 side, and the other portion of the mask member 18B is formed parallel to the belt body 13 of the type belt 12. The inclining angle of the slope 24 is as large angle as a range that the type adjacent in case of pressing the desired type 14 of the type belt 12 by the hammer member 17 does not contact the platen 15.

Then, the operation of the embodiment described above will be described.

FIG. 2(A) shows the state when the type 14 to be printed is selected by moving the type belt 12 at idling time, i.e., without printing. In order to print the selected desired type 14 on a sheet S on the platen 15 in this state, the hammer member 17 is energized to press the end of the hammer member 17 to the back of the desired type 14. Then, the types 14*a*, 14*a* adjacent to the type 14 and the type 14*b* adjacent to the type 14*a* are so pressed in a direction for approaching the platen 15 as to be pulled to the type 14 to be printed, but the mask members 18B is disposed in front of the types 14*a*, 14*b*, the belt body 13 of both sides of the types 14*a*, 14*b* laterally of the type belt 12 is contacted with the mask member 18B to prevent the types 14*a*, 14*b* from moving forward, thereby preferably printing the sheet S on the platen 15 by the type 14.

The masks 18B for preventing the types 14*a*, 14*b* from moving forward are formed with slopes 24 at the positions opposed to the types 14*a* to be bent at the positions opposed to the gap between the types 14*a* and 14*b*. Therefore, when the hammer member 17 presses the back of the type 14 of the type belt 12, the belt body 13 is bent along the mask member 18B at the interval between the types 14*a* and 14*b* so that the belt body 13 at both sides of the type 14*a* laterally of the type belt 12 is projected forward at the type 14 side to be oblique along the slope 24 of the mask member 18B. As a result, the belt body 13 of the type belt 12 is not so extended even in the state that the desired type 14 is pressed on the sheet S on the platen 14. Therefore, the pressing force of the hammer member 17 for pressing the type 13 may be small to reduce the size of the pressing member.

In the embodiment described above, the slope 24 of the mask member 18B is planely inclined. However, the slope 24 may be bent. This invention is not limited to the particular embodiment described above. Various changes and modification may be made within the spirit and scope of the present invention.

According to this invention as described above, the desired type can be preferably printed without mixture of colors by the mask members not directly covered on the type, and the pressing force of typing can be reduced.

What is claimed is:

1. In a printer of the type having a carriage movable along a platen in a lateral direction, a hammer mounted on the carriage and selectively actuable for movement in a printing direction toward the platen, which is perpendicular to the lateral direction, for printing on a paper placed thereon, a type belt interposed between the hammer and the platen formed by a belt body and a plurality of types spaced apart thereon by a predetermined spacing in the lateral direction, each type being connected to its adjacent types by connecting portions of the belt body, means for moving the type belt in the lateral direction so as to position a selected type in front of the hammer to be pressed against the platen for printing on the paper, and a pair of mask members interposed between the type belt and the platen and defining an opening therebetween through which a selected type is pressed by the hammer, said pair of mask members operating to restrain the type belt and prevent the adjacent types on both sides of the selected type from being pressed against the paper, the improvement wherein said pair of mask members are each formed by one portion which extends in the lateral direction in parallel to the type belt and an inclined portion which extends from said one portion at an inclined angle toward said platen at said opening between said mask members, such that when said hammer is actuated to press the selected type through said opening, the type belt is pressed against said mask members and bent along the inclined angle of said inclined portion in order to facilitate the pressing of the selected type against the platen and reduce the pressing force of the hammer required to print with the selected type.

2. The improvement in a printer according to claim 1, wherein said inclined portion has a planar slope.

3. The improvement in a printer according to claim 1, wherein said belt body has upper and lower portions extending in the lateral direction along upper and lower sides of said types, and said mask members are correspondingly formed by an upper pair of mask members and a lower pair of mask members, wherein each of said upper and lower pairs of mask members are formed with said inclined portions and operate to restrain said type belt along its upper and lower portions, respectively.

* * * * *